US006896010B2

(12) United States Patent
Cebola et al.

(10) Patent No.: US 6,896,010 B2
(45) Date of Patent: May 24, 2005

(54) METHOD AND DEVICE FOR FILLING A PAINT RESERVOIR IN AN AUTOMATED PAINTING INSTALLATION

(75) Inventors: Dominique Cebola, Voiron (FR); Michel Fouvet, Champagnier (FR)

(73) Assignee: Eisenmann France Sarl (FR)

( * ) Notice: Subject to any disclaimer, the term of this patent is extended or adjusted under 35 U.S.C. 154(b) by 0 days.

(21) Appl. No.: 10/363,250

(22) PCT Filed: Sep. 4, 2001

(86) PCT No.: PCT/FR01/02739

§ 371 (c)(1),
(2), (4) Date: Aug. 22, 2003

(87) PCT Pub. No.: WO02/20173

PCT Pub. Date: Mar. 14, 2002

(65) Prior Publication Data

US 2004/0020551 A1 Feb. 5, 2004

(30) Foreign Application Priority Data

Sep. 5, 2000 (FR) ..... 00 11309

(51) Int. Cl.[7] ..... B65B 3/04

(52) U.S. Cl. ..... 141/2; 141/18; 141/92; 141/98; 141/248; 118/313

(58) Field of Search ..... 141/2, 18, 90–92, 141/98, 234, 248; 118/300, 302, 313–315

(56) References Cited

U.S. PATENT DOCUMENTS

| | | | | |
|---|---|---|---|---|
| 5,196,067 A | | 3/1993 | Lacchia | |
| 5,772,125 A | * | 6/1998 | Ehinger et al. | 239/694 |
| 6,309,464 B1 | * | 10/2001 | Anfindsen | 118/668 |

FOREIGN PATENT DOCUMENTS

| | | |
|---|---|---|
| EP | 0274322 | 7/1988 |
| EP | 0435005 | 7/1991 |
| JP | 6190309 | 12/1994 |
| WO | WO 94 22590 | 10/1994 |
| WO | WO 98 51415 | 11/1998 |

* cited by examiner

*Primary Examiner*—Gregory L. Huson
*Assistant Examiner*—Peter deVore
(74) *Attorney, Agent, or Firm*—Cantor Colburn LLP

(57) ABSTRACT

The invention concerns painting installations comprising painting machines or robots (6*a*, 6*b*, 7*a*, 7*b*, 8*a*, 8*b*, 9*a*, 9*b*), each with a sprayer (12) and a paint reservoir (13), associated with the sprayer and designed to supply it, the machines or robots being arranged along a painting line for motor vehicle bodies (2). Each machine or robot is provided with a fluidic connector, designed to co-operate discontinuously with a dispensing system (14*a*, 14*b*, 15*a*, 15*b*) comprising a color shade-changing unit. Each dispensing system (14*a*, 14*b*, 15*a*, 15*b*) is arranged between two consecutive machines (6*a*, 7*a*; 6*b*, 7*b*; 8*a*, 9*a*; 8*b*, 9*b*), and is common to those two machines, which are successively connected thereto to fill their respective reservoirs each time there is a color shade change.

8 Claims, 3 Drawing Sheets

METHOD AND DEVICE FOR FILLING A PAINT RESERVOIR IN AN AUTOMATED PAINTING INSTALLATION

TECHNICAL FIELD OF INVENTION

The present invention relates, in a general manner, to the field of automated painting installations useable in particular for applying paint and especially electrically conducting paint or other similar coating product to automobile bodies. This invention pertains, more particularly, to the filling of the paint reservoirs, in the case of installations using painting machines or robots each carrying a mobile reservoir intended for supplying a paint spray gun or cup.

DESCRIPTION OF RELATED ART

Known devices of this kind, such as described in the documents EP 0 274 322, EP 0 435 005 and JP 6 190 309, make it possible to rinse, then dry and subsequently fill an electrically insulated paint reservoir, placed at the end of a robot's arm and intended to supply, according to variable and controlled instantaneous flow rates, electrostatic cups or guns for spraying water-containing paint.

Certain multi-axis robots for applying paint to automobile bodies are furnished with a bulky mechanism present throughout the length of the paint application booth, which allows them to follow bodies moving longitudinally on a conveyor. These mechanisms thus occupy the greater part of the length of the booth, thereby making it necessary to install the color changing systems inside the booth, so that they can be accessed by the arms of the robots.

Painting robots of simpler design are also known, usually referred to as "machines", which have at least two orthogonal spindles, but which do not follow the bodies longitudinally as they advance on the conveyor.

For such installations, shade changing systems, making it possible to feed the reservoir with a paint of a color selected from several, are indispensable. The shade changing systems are placed either in a booth, in the zone which can be accessed by the end of the arm of the robot, or, in the case of "machines", in the frame of the machine itself, or even in an "on-board" setup, on one of the spindles of the machine as indicated in the document EP 0 691 892.

A system for changing shades by robot or by machine exists in principle. In the particular case of the so-called "roof" machine, which carries from two to four sprayers, there is a shade changing system for each sprayer.

More particularly, in installations of the kind considered here, the reservoir consists of a cylindrical chamber with a fixed maximum capacity, housing a piston. The piston is driven back during the reservoir filling phase, then it is thrust forward during the spraying phase. The movements of the piston are controlled and measured so as to be able at any incident to know the quantity of paint present in the reservoir and the instantaneous flow rate of sprayed paint.

The assembly consisting of a sprayer and of the associated reservoir is furnished with a multiple fluidic connector, for example having three connection points. A first connection point makes it possible to inject firstly a cleaning liquid so as to rinse the reservoir, then air making it possible to drive the cleaning product toward a drain, through a second connection point, and finally paint or other coating product required to fill the reservoir in sufficient quantity. The third and last connection point makes it possible to rinse only the spray nozzle.

The dispensing of the paint and of the other fluids is effected by a fixed dispensing system, which comprises in particular a shade changer unit supplied with paint of the various shades to be selected, said unit comprising multiple inlets, regulated valves and a single outlet. This dispensing system comprises a connection assembly, for example having three points corresponding to those of the fluidic connector of the sprayer. In particular, one point of the connection assembly is attached to the outlet of the shade changer unit, another point is attached to a rinsing unit comprising an air valve and a solvent valve, and the last connection point is attached to a drain making it possible to collect the cleaning residues.

When the robot or the machine has just finished painting or coating a body with a certain shade, the fluidic connector of the sprayer comes up against the connection assembly linked to the outlet of the shade changer unit. The reservoir is then cleaned by injecting the cleaning product, which is thereafter discharged to the drain, while the nozzle of the sprayer is itself rinsed with solvent and then with air. Thereafter, compressed air drives the solvent toward the drain, and the reservoir is filled with paint of a new shade, selected and dispensed by the shade changer unit.

It will be noted that, in a conventional painting line for automobile bodies, on average around 25 different shades are applied, with a change of shade made on average every 1.5 bodies. Such a line producing from 40 to 60 bodies per hour, for a service period of from 16 hours minimum up to 24 hours a day, this represents, as an order of magnitude, between 600 and 1000 changes of shade per day and per sprayer.

Moreover, it will be noted that during each change of shade, all the paint or coating product, contained in the dispensing duct of the shade changer unit, is lost. The same is true for the cleaning product, usually a solvent or demineralized water added to glycol, which is then used to clean and rinse the duct of the shade changer unit, this cleaning product being, after use, discharged to a drain.

It is therefore understood that the overall loss of paint or coating product, and of cleaning product, and the associated financial cost, relating to the changes of shade, are extremely high in a given installation, this loss and the associated cost having to be multiplied by the number of sprayers, since each sprayer is assigned its own shade changing system. To this is added a pollution problem, which stems from the wastage of paint and rinsing product which are lost as explained hereinabove.

The investment cost of such a shade changing system is, likewise, relatively sizeable, since it has to be multiplied by the number of sprayers of the installation.

To this are also added the time and the costs incurred in maintaining the shade changing systems and the costs of the loss of production. Whether it be a machine or a robot, and whether the shade changing system be situated in the painting booth or in the frame of the machine, it is necessary for safety reasons to shut down the installation or even the entire painting line, or at the very least the machine, in order to access the shade changing systems and perform the maintenance operations which in most cases require intervention inside the booth. In view of the sizeable number of shade changing cycles (as indicated above), it is necessary to make provision for preventive maintenance interventions of greater or lesser length and frequency. Here again, the scale and the overall cost of maintenance are directly proportional to the number of shade changing systems.

Insofar as the number of changes of shade, and the number of sprayers, constitute unmodifiable parameters, it is apparently difficult to achieve a reduction in the losses of paint and of rinsing product, as well as a reduction in the maintenance operations, and to reduce the scale of the resulting costs and pollution.

SUMMARY OF INVENTION

The present invention aims to solve these problems, by providing a technical solution which, without modifying the machines or the robots themselves, affords a sizeable reduction in the losses of paint and of rinsing product, during changes of shade, and which also greatly limits the maintenance operations, thereby resulting in a sizeable decrease in the operating costs and in the production losses of an installation of the kind concerned, to which is added an appreciable reduction in the initial investment.

Accordingly, the first subject of the invention is a method for filling a paint reservoir, in an automated painting installation of the kind concerned, i.e. one comprising painting machines or robots each with sprayer and reservoir for paint or other coating product, associated with the sprayer and intended to supply it, these machines or robots being arranged along a painting line, in particular for automobile bodies, each assembly consisting of a sprayer and of the associated reservoir being provided with a fluidic connector designed to cooperate in a discontinuous manner with a dispensing system, comprising a shade changer unit supplied with paint of various colors, and a fluidic connection assembly attached to the outlet of the shade changer unit, this method being characterized in that at least two machines or robots use the same dispensing system to which they connect successively, with each change of shade, so as to successively rinse and fill with paint their respective reservoirs, associated with their respective sprayers.

The subject of the invention is also a device for implementing the method defined above, this device comprising, for two painting machines or robots each with sprayer and paint reservoir, arranged consecutively along the painting line, a common dispensing system with color changer unit and fluidic connection assembly attached to the outlet of the shade changer unit, the dispensing system being placed between the two machines or robots in such a way as to be able to be used by one or other of these machines or robots, for rinsing and filling their respective reservoirs, associated with their respective sprayers.

Thus, the inventive idea consists in designing a single dispensing and shade changing system for two machines or robots, allowing these two machines or robots to use the same dispensing system to rinse and fill their respective reservoirs, in contradistinction to the conventional installations which comprise at least as many dispensing systems, with shade changer, as machines or robots.

The invention therefore makes it possible to halve the number of dispensing systems, with shade changer unit and fluidic connection assembly, thereby already reducing the initial investment, as well as the maintenance times and costs.

Above all, by virtue of the arrangements of the present invention, during changes of shade, the paint contained in the duct of the shade changer unit is lost only once, for two machines or robots, and the losses of paint and of rinsing product are thus halved in total for the relevant installation as a whole. Of course, the costs and the pollution resulting from these losses are also reduced considerably.

According to a preferred embodiment of the device which is the subject of the invention, a motorized hatch is disposed in the wall of the painting booth for the passage of the fluidic connection assembly attached to the outlet of the shade changer unit and designed to be mobile, toward the inside of the booth, with a view to the rinsing and filling of the paint reservoir associated with the sprayer of one or other of the two machines or robots between which the dispensing system is placed.

In particular, the shade changer unit can be fixed, and situated outside the painting booth, in which case the fluidic connection assembly is attached by flexible pipes to fixed dispensing points of the dispensing system.

The hatch is open only when this is necessary in order to supply the two machines or robots, so as to keep the booth leaktight. The setup of the dispensing system makes it possible to carry out interventions on the shade changing means without having to enter the paint application booth and without having to shut the installation down, this further helping to minimize the shutdown times required for maintenance and to avoid large production losses. It should be noted that the in-booth interventions bring about the incursion of dust into the filtered air and, hence, the defects of appearance which may give rise to the scrapping of numerous bodies, hence the importance of this last arrangement.

According to a particular mode of execution, the fluidic connection assembly of the dispensing system is rendered moveable through the motorized hatch brought into the open position, between the outside and the inside of the painting booth, for example by means of a jack, pipes for example flexible attaching this mobile fluidic connection assembly to dispensing points of the dispensing system, in particular to the outlet of the shade changer unit.

BRIEF DESCRIPTION OF THE DRAWINGS

The invention will be better understood with the aid of the description which follows, with reference to the appended schematic drawing representing, by way of example, one form of execution of this device for filling a paint reservoir, in an automated painting installation:

FIG. 1 very schematically represents a portion of an automobile body painting line. The bodies 2 to be painted advance down this line, along the arrow F, one behind the other with a certain spacing e, being moved by a conveyor symbolized as 3. The bodies 2 thus move inside a closed painting booth 4 whose opposite side walls, respectively on the right and left (with respect to the direction of advance), are indicated as 5*a* and 5*b*.

DETAILED DESCRIPTION OF INVENTION

Arranged in succession on both sides of the painting booth 4 are painting machines or robots, placed facing one another, i.e. for example:

on the right side of the booth 4, successive machines 6*a*, 7*a*, 8*a* and 9*a;* on the left side of the booth 4, successive machines 6*b*, 7*b*, 8*b* and 9*b;*

Figure 2:
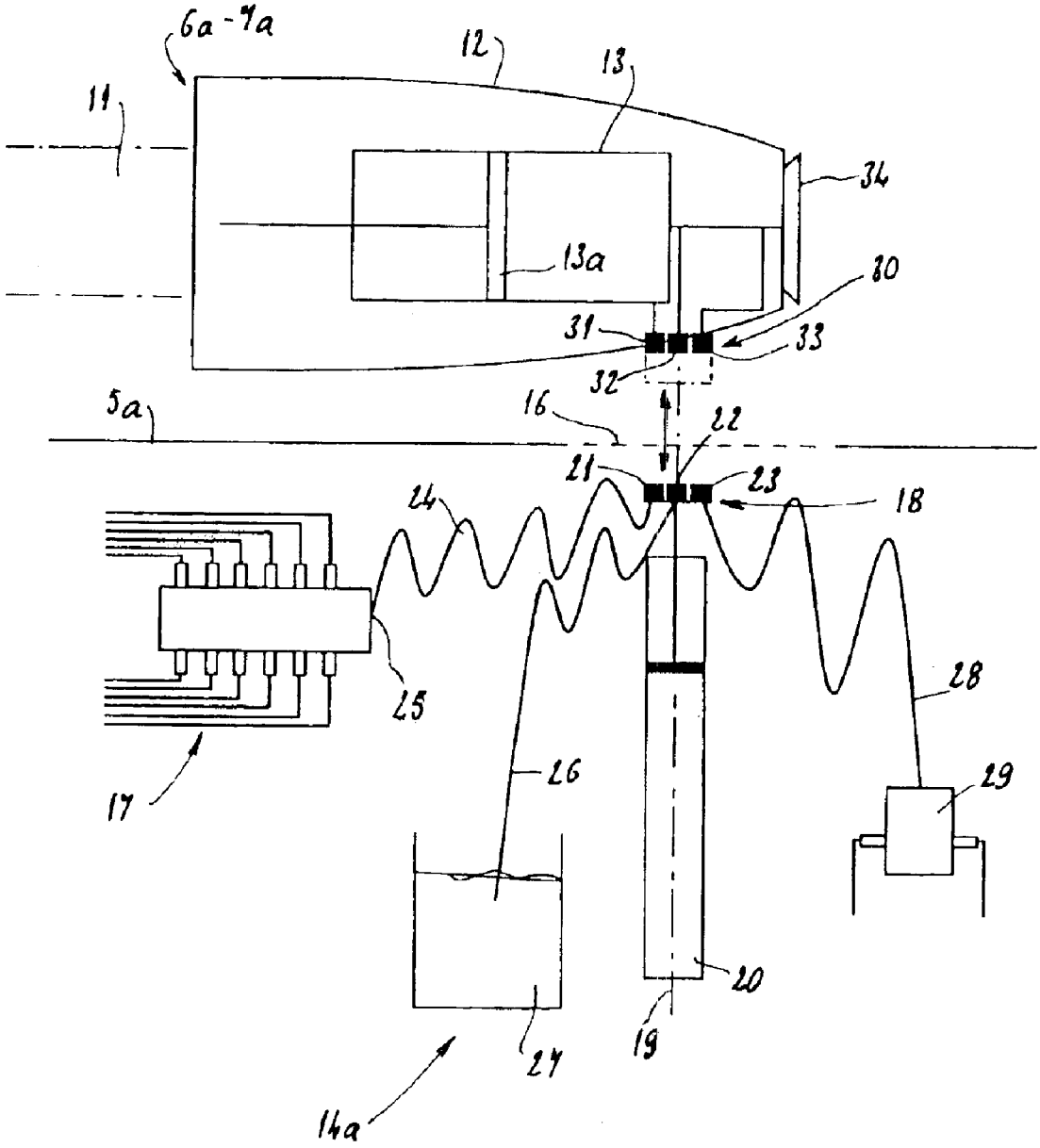
FIG. 2 represents the detail of one of these devices, with indication of a reservoir to be filled.

Each painting machine possesses a fixed frame 10, and a mobile arm 11 situated inside the booth 4 and carrying, at its end, a sprayer 12 with which is associated a paint reservoir 13 with piston 13*a* (visible in FIG. 2).

On each side of the booth 4, the machines 6*a* to 9*a*, or 6*b* to 9*b*, are spaced at intervals E, of for example between 2.5 and 3 meters.

According to the invention, all these machines are, on each side of the booth 4, associated pairwise as far as the supplying of their reservoirs 13 with paint is concerned, that is to say there is provided a dispensing system common to two consecutive machines, i.e. in detail:

a dispensing system 14*a* common to two machines 6*a* and 7*a*, and situated between these two machines;

a dispensing system 14*b* common to two machines 6*b* and 7*b*, and situated between these two machines;

a dispensing system 15*a* common to two machines 8*a* and 9*a*, and situated between these two machines;

a dispensing system 15*b* common to two machines 8*b* and 9*b*, and situated between these two machines.

Figure 1:
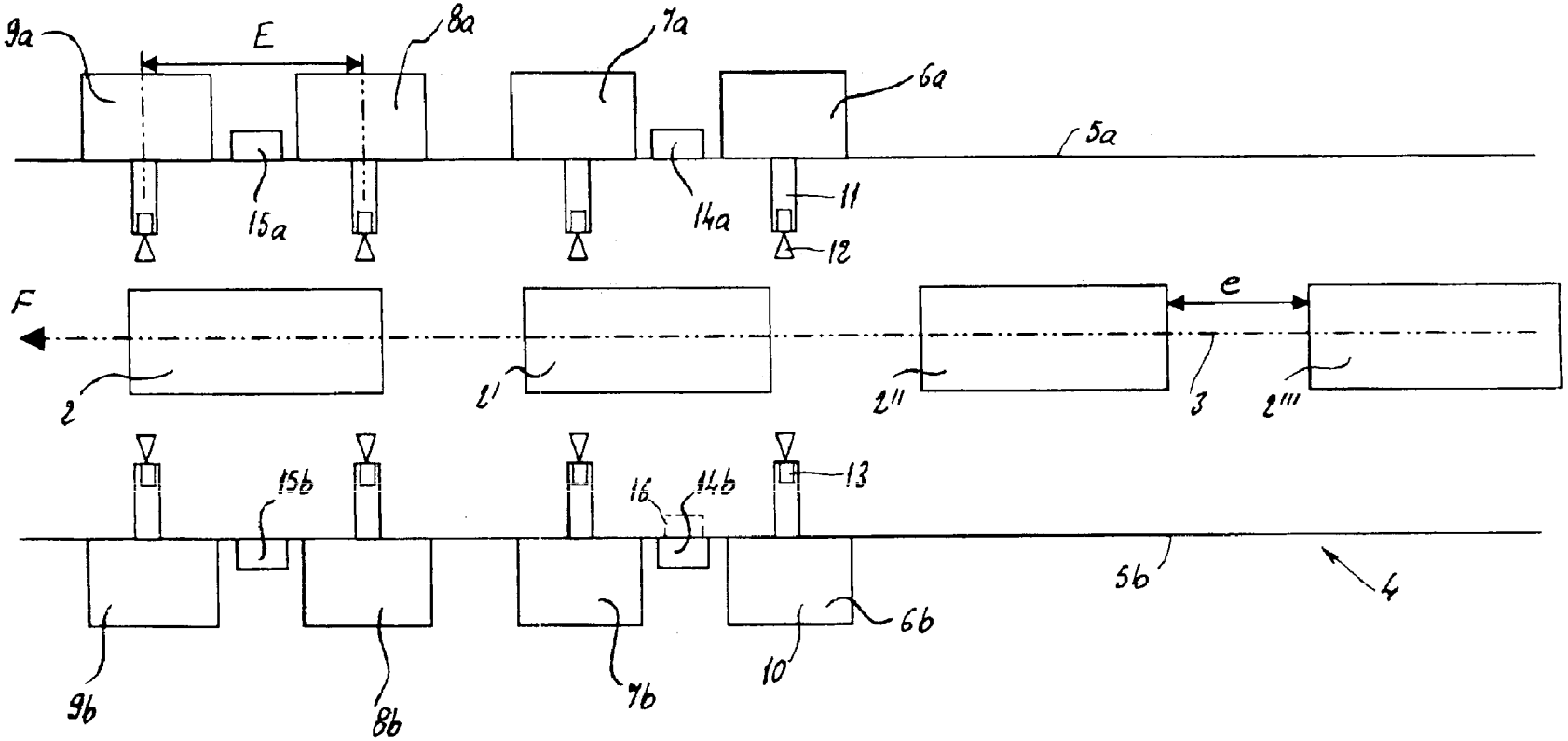
FIG. 1 is a very schematic plan view of a painting line equipped with devices in accordance with the present invention.

As again shown by FIG. 1, each dispensing system 14*a*, 14*b*, 15*a*, 15*b* is situated outside the painting booth 4.

An electrically or pneumatically motorized hatch 16 is disposed in the wall 5*a* or 5*b* of the booth 4, in correspondence with each dispensing system.

Referring to FIG. 2, each dispensing system such as the system 14*a* comprises a shade changer unit 17, supplied with paint and/or with coating product, of various shades, by the circuits (not represented) of the installation.

The dispensing system also possesses a fluidic connection assembly 18, mounted so as to be mobile in translation along an axis 19 perpendicular to the wall 5 of the booth 4, and driven along the axis 19 by a jack 20. The connection assembly 18 is thus moveable between the outside of the booth 4, and the inside of the booth 4, the opening of the hatch 16 allowing the passage of this connection assembly 18 from the outside to the inside of the booth 4. A variant would consist in moving the shade changer unit 17 as a whole, with the connection assembly 18, through the hatch 16.

The mobile fluidic connection assembly 18 comprises three connection points, 21, 22 and 23 respectively:

the first connection point 21 is attached, by a hose 24, to the outlet 25 of the shade changer unit 17.

the second connection point 22 is attached, by another hose 26, to a drain 27.

the third connection point 23 is attached, by a last hose 28, to a rinsing unit 29 comprising an air valve and a solvent valve.

Referring again to FIG. 2, the sprayer 12 of any one of the painting machines, with which the paint reservoir 13 is associated, is provided with a fluidic connector 30 comprising three connection points 31, 32 and 33, which correspond, respectively, to the three connection points 21, 22 and 23 of the connection assembly 18 of a dispensing system such as 14*a:* the first connection point 31 is linked directly to the reservoir 13 and ensures the filling thereof.

the second connection point 32 is designed for drainage.

the third connection point 33 is hooked up directly to the nozzle 34 of the sprayer 12, for the rinsing of the nozzle.

When a machine has just finished a body 2 of a certain shade, its mobile arm 11 is moved in such a way as to position the sprayer 12 at a precise point of the booth 4, facing the dispensing system assigned to this machine. The hatch 16 being open, the jack 20 thrusts the mobile connection assembly 18 so that it "docks" alongside the fluidic connector 30 of the sprayer 12 (chain-dotted position of FIG. 2), the three connection points 21, 22 and 23 then coming respectively into coincidence with the other three connection points 31, 32 and 33.

The reservoir 13 is then cleaned by injecting solvent from the shade changer unit 17, through the hose 24, the solvent having cleaned the reservoir 13 continuing on its way through the hose 26 to the drain 27. Simultaneously, the nozzle 34 is itself rinsed with solvent, then with air, which are fed through the hose 28. Thereafter, compressed air drives the solvent into the drain 27 and the reservoir 13 is filled with paint of the new shade selected by the shade changer unit 17, this paint being fed through the hose 24.

The jack 20 is thereafter retracted, in such a way as to withdraw the mobile connection assembly 18, while the machine is ready to perform the coating of a new body 2, with the paint of the new selected shade.

A rinsing and filling process, described above, is performed successively, by the same dispensing system such as 14*a*, for the filling of the respective reservoirs 13 of the sprayers 12 of the two machines, such as 6*a* and 6*b*, between which the relevant dispensing system is placed. Stated otherwise, with each change of shade, the same connection system 18 "docks" alongside, successively, the fluidic connectors 30 of one then of the other of these two machines 6*a* and 6*b*, which connectors are brought one after the other into the same predefined position.

Thus, referring again to FIG. 1, the overall manner of operation of the installation is as follows:

We consider the assembly of four machines 6*a*, 7*a*, 6*b*, 7*b*, at the moment at which the machines 6*a* and 6*b* situated furthest to the rear have finished painting a certain body 2'. The machines 6*a* and 6*b* will then position themselves in the rinsing/filling position, that is to say respectively in front of the dispensing systems 14*a* and 14*b*. The jacks 20 of these systems then "dock" alongside the connectors 30 of the respective sprayers 12 of the two machines 6*a* and 6*b*, and the cleaning and filling cycles (detailed above) are performed simultaneously, for these two machines 6*a* and 6*b*, with a possible change of color, in accordance with the shade envisaged for the next body 2". The reservoirs 13 of the two machines 6*a* and 6*b* being filled by the paint of the selected shade, these machines 6*a* and 6*b* will position themselves in such a way as to be ready to begin coating the next body 2".

These operations are performed while the two machines 7*a* and 7*b* are finishing painting the body 2'. As soon as the machines 7*a* and 7*b* have finished their work, and the dispensing systems 14*a* and 14*b* are released, the machines 7*a* and 7*b* will, in their turn, position themselves in the rinsing/filling position, that is to say respectively in front of the dispensing systems 14*a* and 14*b*. The jacks 20 of these systems then "dock" alongside the connectors 30 of the respective sprayers 12 of the two machines 7*a* and 7*b*, and the cleaning and filling cycles, with possible change of color (in accordance with the shade of the next body 2") are also performed for these two machines 7*a* and 7*b*. The filling of the reservoirs 13 of these last machines being completed, the latter will also position themselves in such a way as to be ready to begin coating the next body 2".

The operating cycle is exactly the same for the other painting machines 8*a*, 9*a*, 8*b*, 9*b*, and it is of course repeated for the subsequent bodies such as the body 2'", especially in the event of a change of shade relative to a previous body.

Thus, during changes of shade, the paint contained in the outlet duct of the shade changer unit 17 is lost only once, for two machines. For example, for the dispensing system 14*a*, the outlet duct of the shade changer 17 can remain filled with the paint used for the machine 6*a*, since this same paint will serve for the machine 6*b*. The losses of paint and of rinsing product are thus halved for the installation as a whole.

Additionally, each dispensing system 14*a*, 14*b*, 15*a*, 15*b* being situated outside the booth 4, the interventions on these systems can be carried out readily, without shutting down the entire installation.

Figure 3:
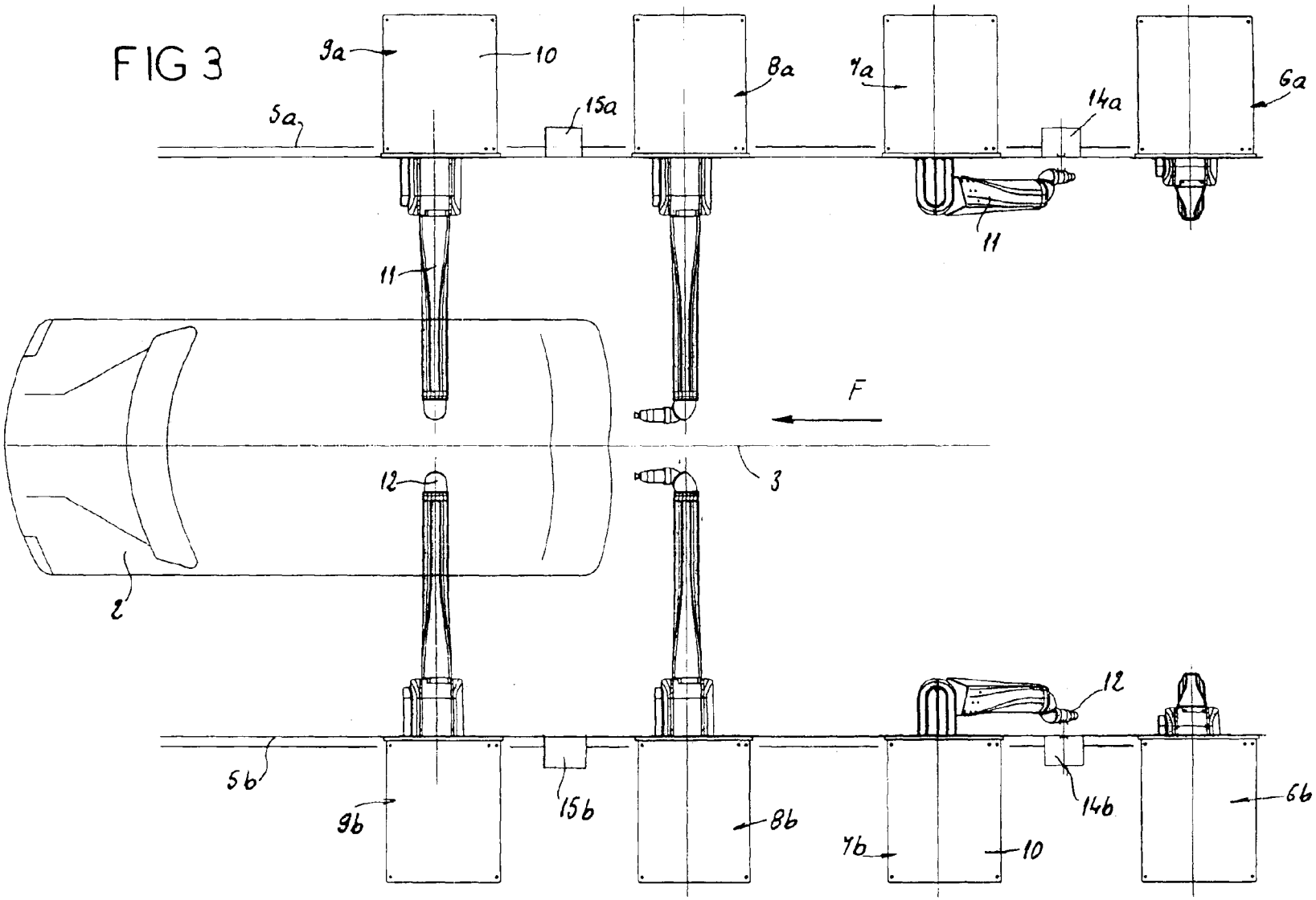
FIG. 3 is a more detailed plan view of a slice of the painting line of FIG. 1.

FIG. 3 represents certain components in greater detail, in particular the mobile arms 11 and the sprayers 12 of the various machines. This FIG. 3 also illustrates, more particularly, certain operating phases; thus, in the situation represented:

the two machines 6*a* and 6*b* are in the idle or standby position;

the two machines 7*a* and 7*b*, having their arm 11 folded back toward the corresponding side 5*a* or 5*b* of the booth 4, are in the docking position facing the dispensing system 14*a* or 14*b* which is assigned to them;

the two machines 8*a* and 8*b* are currently painting the rear of a body 2;

the two machines 9*a* and 9*b* are currently painting the roof of the same body 2.

One would not be departing from the scope of the invention, as defined in the appended claims:

by modifying the constructional details of the dispensing systems, with the proviso that one of these systems remains common to at least two machines or robots;

by making provision, on these dispensing systems, for fluidic connection assemblies 18 having more or fewer connection points, in correspondence with the connectors fitted to the sprayers;

by moving the shade changer unit 17 together with the connection assembly 18, through the hatch 16 between the outside of the painting booth 4 and the inside of this booth, thus allowing a saving on the paint contained in the hose 24;

by making provision for the rinsing unit 29 likewise to be moveable together with the connection assembly 18, through the hatch 16, between the outside and the inside of the painting booth 4;

by using this filling device in respect of painting machines or robots of any type, having more or fewer spindles;

by applying the invention to painting installations or lines of various configurations, with a greater or lesser number of machines or robots.

What is claimed is:

1. A method for filling a paint reservoir in an automated painting installation including painting machines each with a sprayer and a reservoir for paint associated with the sprayer and intended to supply the sprayer, the machines being arranged along a painting line, each sprayer and the associated reservoir being provided with a fluidic connector designed to cooperate in a discontinuous manner with a dispensing system including a shade changer unit supplied with paint of various colors and a fluidic connection assembly attached to an outlet of the shade changer, the method comprising:

using the same dispensing system to which the machines connect successively, with each change of shade, so as to successively rinse and fill with paint the respective reservoirs, associated with the respective sprayers.

2. A device for filling a paint reservoir in an automated painting installation, comprising:

two painting machines arranged consecutively along a painting line;

a sprayer for each painting machine;

a paint reservoir for each painting machine;

a common dispensing system with a shade changer unit and a fluidic connection assembly attached to an outlet of the shade changer; and a dispensing system disposed between the two machines in such a way as to be able to be used by one or other of the machines for rinsing and filling the respective reservoirs associated with the respective sprayers.

3. The device as claimed in claim 2, wherein a motorized hatch is disposed in a wall of the painting installation for passage of the fluidic connection assembly attached to the outlet of the shade changer unit and designed to be mobile, toward an inside of the installation for the rinsing and filling of the paint reservoir associated with the sprayer of one or other of the two machines between which the dispensing system is disposed.

4. The device as claimed in claim 3, wherein the fluidic connection assembly of the dispensing system is rendered moveable through the motorized hatch brought into an open position, between an outside and the inside of the painting installation, by means of a jack.

5. The device as claimed in claim 4, wherein the mobile fluidic connection assembly comprises a first connection point attached by a first hose to the outlet of the shade changer unit a second connection point attached by a second hose to a drain, and a third connection point attached by a third hose to a rinsing unit.

6. The device as claimed in claim 4, wherein the shade changer unit is fixed and situated outside the painting installation, the fluidic connection assembly being attached by flexible pipes to fixed dispensing points of the dispensing system.

7. The device as claimed in claim 4, wherein the shade changer unit is moveable with the connection assembly through the hatch between the outside and the inside of the painting installation.

8. The device as claimed in claim 5, wherein the rinsing unit is moveable with the connection assembly through the hatch between the outside and the inside of the painting installation.

* * * * *